United States Patent [19]

Christiansen

[11] Patent Number: 5,020,353

[45] Date of Patent: Jun. 4, 1991

[54] METHOD OF MACHINING AN OBLONG WORKPIECE AND A MACHINE FOR PERFORMING THE METHOD

[75] Inventor: Christian M. Christiansen, Skanderborg, Denmark

[73] Assignee: Enkotec A/S, Skanderborg, Denmark

[21] Appl. No.: 473,997

[22] PCT Filed: Oct. 25, 1988

[86] PCT No.: PCT/DK88/00172

§ 371 Date: Jun. 20, 1990

§ 102(e) Date: Jun. 20, 1990

[87] PCT Pub. No.: WO89/03735

PCT Pub. Date: May 5, 1989

[30] Foreign Application Priority Data

Oct. 26, 1987 [DK] Denmark ..... 5602/87

[51] Int. Cl.[5] ..... B21G 3/12

[52] U.S. Cl. ..... 72/187; 10/52

[58] Field of Search ..... 10/52, 58, 66, 69; 72/91, 184, 187, 190, 191

[56] References Cited

U.S. PATENT DOCUMENTS 1,647,830 11/1927 Humphris .
2,872,887 2/1959 Praturlon ..... 72/191
2,917,756 12/1959 Stearns et al. ..... 10/52
4,052,873 10/1977 Murzin et al. ..... 72/187
4,309,885 1/1982 Nielsen et al. .

FOREIGN PATENT DOCUMENTS 188186 10/1987 Denmark .
582953 1/1925 France .
847717 9/1960 United Kingdom .

*Primary Examiner*—Lowell A. Larson
*Attorney, Agent, or Firm*—Ladas & Parry

[57] ABSTRACT

A method of machining an oblong workpiece, which is placed substantially radially in a holding ring and is deformed by cooperation with a roller rotating in the holding ring. In connection with machining of a relatively large amount of material, the workpiece is caused to cooperate with a plurality of differently shaped areas on the surface of the roller. The method is performed by a machine which comprises a rotating holding ring for substantially radial retention of the workpieces. The machine comprises a rotating roller which is placed inside the holding ring and is adapted to machine the radially inwardly directed end of the workpieces. At least two differently shaped types of the machining areas are provided along the surface of the roller, said areas being so disposed that the various types are present radially opposite a workpiece in a predetermined succession at least at the same time as the holding ring performs a corresponding number of entire revolutions.

17 Claims, 9 Drawing Sheets

METHOD OF MACHINING AN OBLONG WORKPIECE AND A MACHINE FOR PERFORMING THE METHOD

Figure 1:
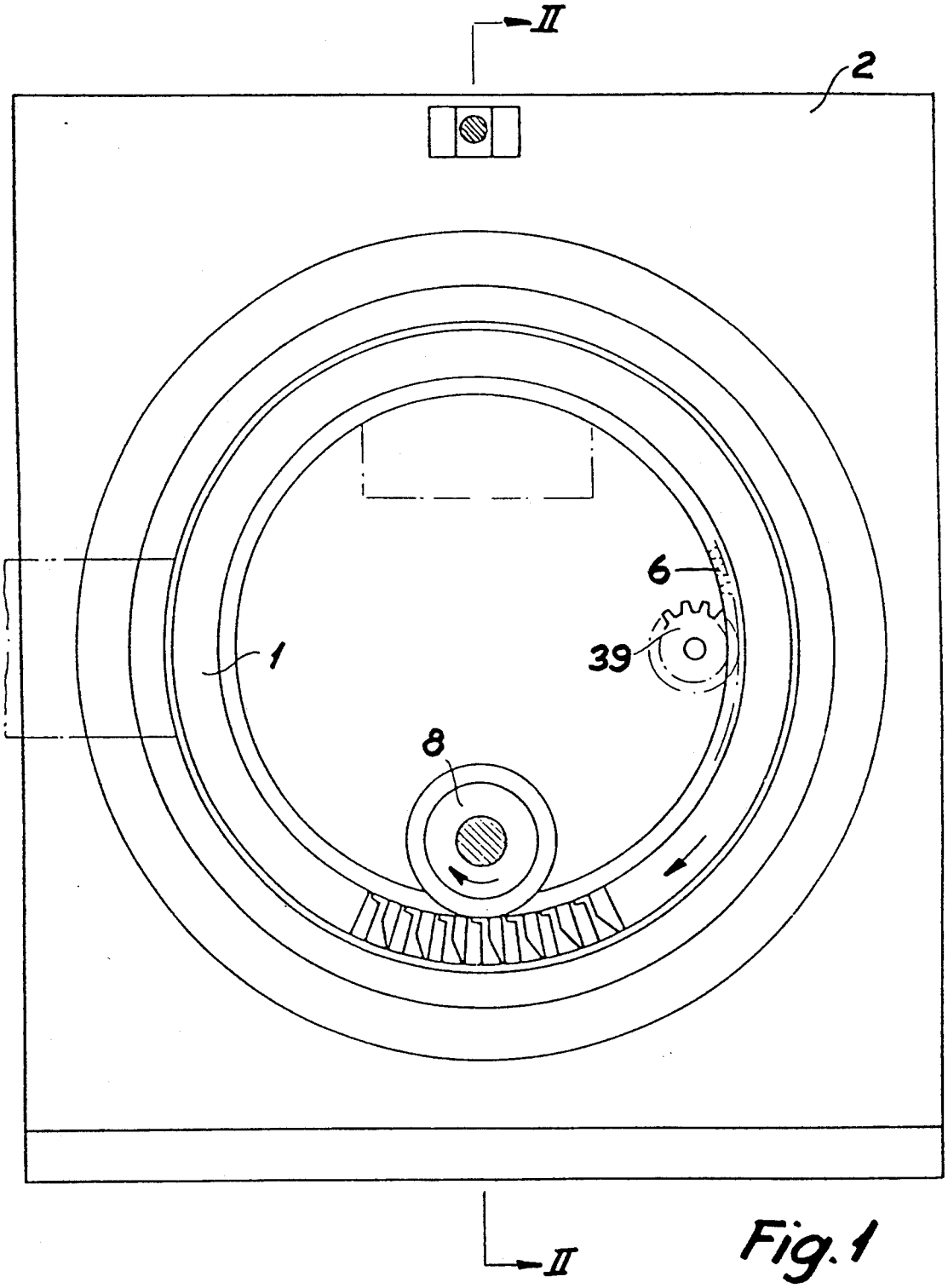

The invention concerns a method of machining an oblong workpiece, which is placed substantially radially in a ring-shaped tool and is deformed by cooperation with a roller rotating in a holding ring.

The Danish Patent Specificaiton 143,935 discloses a machine for machinging oblong workpieces and comprising a rotating holding ring for substantially radial retention of the workpieces, and comprising a rotating roller which is mounted within the tool and is adapted to machine the radially inwardly directed end of the workpieces. This known machine has been a great success for producing nail heads on nail workpieces. Therefore, it has been attempted to produce as many variants of nails as possible by means of this known internal rolling principle. However, it has been found that problems arise when a relatively large amount of material per workpiece is to be machined, i.e. deformed. Examples of such workpieces may be roofing nails or screws.

An object of the invention is to provide a method of the present type which makes it possible to machine a larger amount of material per workpiece than the prior art.

This object is achieved by performing the method in which the roller is driven relative to the position of the workpieces in the holding ring so that each workpiece is caused to cooperate with a plurality of differently shaped areas of the surface of the roller. A first treatment may comprise moving the workpiece material, and one or more subsequent treatments may comprise the final shaping. When the method is performed so that the workpieces are subjected to a preliminary deformation in the form of upsetting of material in that the machining areas on the roller corresponding thereto are provided as mold cavities which extend radially inward toward the center of the roller an upsetting will result, so that the end of the workpiece to be treated will have a modified diameter to length ratio. When the method is performed so that the workpieces are subjected to a preliminary deformation in the form of shearing, of material transverse to the longitudinal direction of the workpiece can be obtained.

When the possibilities provided by the method as defined by combining the above three methods, there will be so much freedom in shaping the workpieces that the access angle between the holding ring and the roller is considerably less critical than is the case in the prior art. The method can moreover be performed no matter whether the peripheral speeds of the holding ring and of the roller are the same. To reduce wear it is preferred to perform the method.

The method of the invention has special relation to the mentioned machining by rotating movement. Thus, it is known to forge a head on a nail in two working operations to avoid problems because of the limited flow rate of the material. However, the flow rate is no problem, either in the known machine or in the present method where the machining rate of the material is already relatively low because of the rolling movement.

The various machining areas are preferably distributed on or in the surface of the roller. When the method is performed so that the workpieces in the holding ring are distributed with the same mutual distance and in a number which is not divisible by the number of machining areas on the roller, the workpieces can be introduced into the holding ring in a very simple manner. In many uses, there will be just two different machining areas on the roller, which entails that the holding must be adapted to receive an odd number of workpieces.

When very accurate machining of material is to be effected over a relatively large radial extent, the shaping areas of the roller may have difficulty in releasing the workpiece. This problem may be avoided by performing the method in which following one or more of the machining processes, the workpieces are subjected to final shaping by means of machining areas rotatably journalled in the roller and that a machining area performs a substantially radial movement with respect to the holding ring from engagement with the workpiece until shaping is completed. This method may e.g. be performed by means of tilting tools journalled in the roller, but these require relatively much space; however, it will be appreciated that if e.g. two or three different machining areas are present on the roller, only the second or the third machining area is to comprise a tilting tool. Therefore, it is sufficient to have a limited number of tools so that these do not reduce the strength of the roller.

The invention also concerns a machine of the type which is described in the above-mentioned Danish patent specification. This machine is characterized by the features defined so that at least two differentially shaped types of machining areas are provided along the surface of the roller, the machining areas being so disposed and the roller so driven that the various types of machining areas are present radially opposite a workpiece in a predetermined succession at least at the same time as the holding ring performs a corresponding number of entire revolutions.

In a preferred embodiment, the first type of machining area is arranged so that a first type of machining area on the group of such areas on the roller are provided as a mold cavity which extends from the periphery of the roller radially inward toward the center of the roller with a narrowed cross-section which results in upsetting of the workpiece. The embodiment of the cavities defined in claim 10 provides a volume of material as great as possible of the upset material, without this causing problems when the cavity releases the workpiece. To obtain lateral shearing of the material, the cavity may be offset. An alternative embodiment for machining areas can bring about shearing of material transverse to the longitudinal direction of the workpiece.

As mentioned before, the peripheral speeds of the roller and of the holding ring may be the same or different, The gear transmission is adapted i.e. the diameter of the roller, the internal diameter of the holding ring, the number of various machining areas as well as the number of groups of machining areas on the roller, and it will be appreciated that the next machining area in a series of treatments of a given workpiece is not necessarily located in adjacent groups of such areas. Thus, the mentioned parameters may be varied in many ways. It has been mentioned before that the workpiece material may be moved by means of the position of the machining area on the roller, but it will also be appreciated that movement of the workpiece material may be provided through a difference between the peripheral speeds of the roller and of the holding ring.

Of course, it is possible in principle to introduce nail workpieces at any time into the rotating holding ring, but if a workpiece insertion station is provided radially opposite the holding ring and the station is adapted to insert workpieces at intervals extending over a plurality of workpieces in the holding ring corresponding to the number of mutually different machining areas on the roller, this may be done with a firmly mounted station, while continuously feeding workpiece material to the station. This avoids discontinuous and reciprocating movements when the workpieces are introduced.

An embodiment in which one of the machining areas in each group is provided as tilting tools having a tilting axis which is disposed outside the axis of the roller and parallel to it in which the tilting tools corresponding to each of the machining areas is provided as roller selections movable in the radial plane of the roller, allows shaping to be possible over a relatively large radial extent. The machining area can therefore readily release the workpiece and accordingly provide exact shaping and thus be adapted to calibration. Then, e.g. cross slots may be calibrated in screws, where the screw head and at least an initial machining of the slot may have been performed in one or more preceding working operations.

Figure 2:
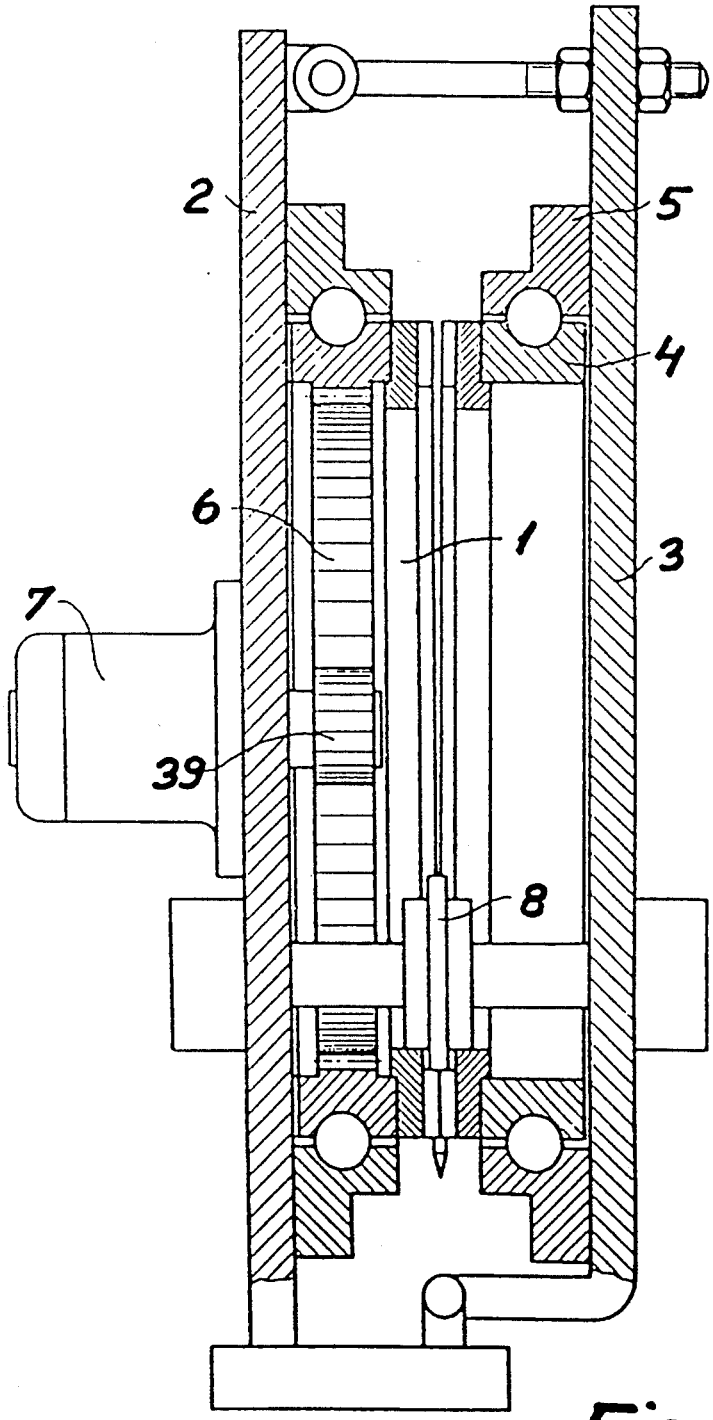
Figure 3:
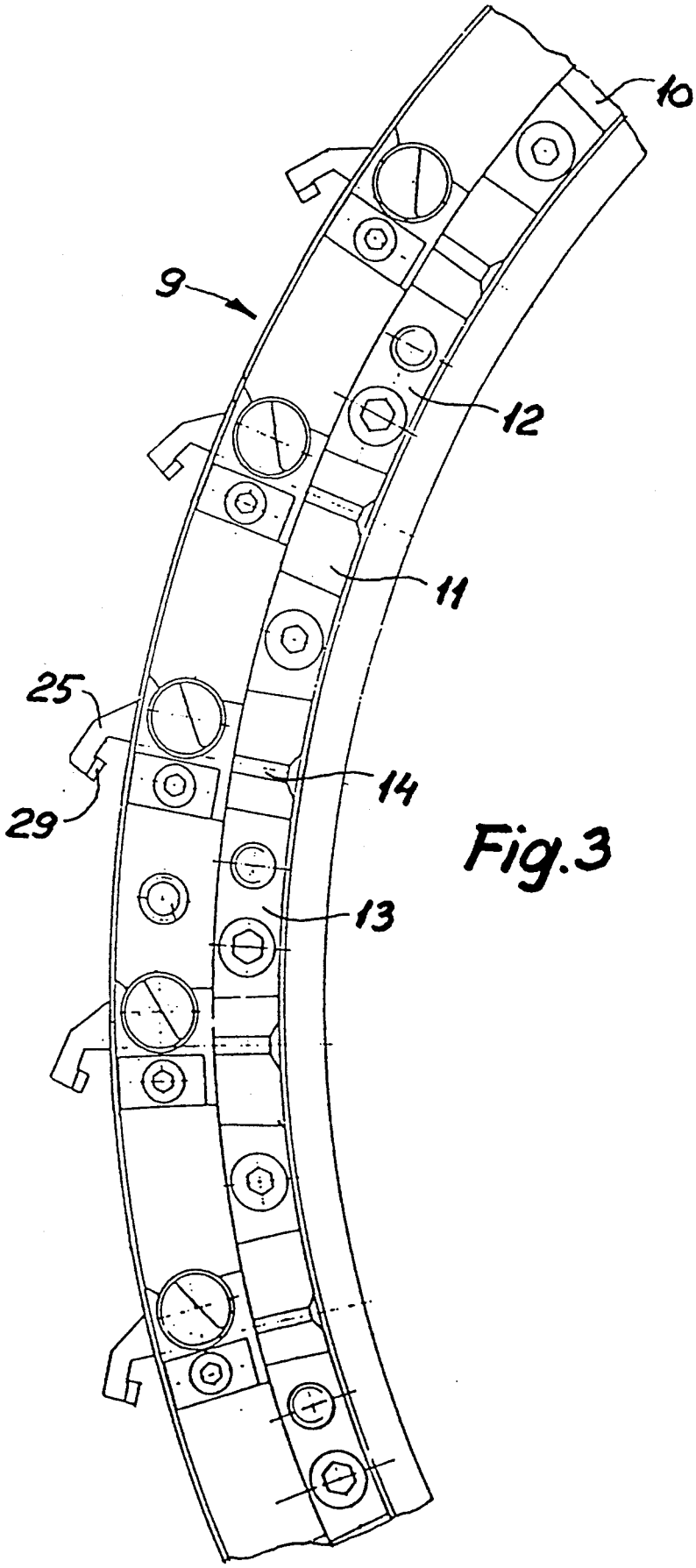
Figure 4:
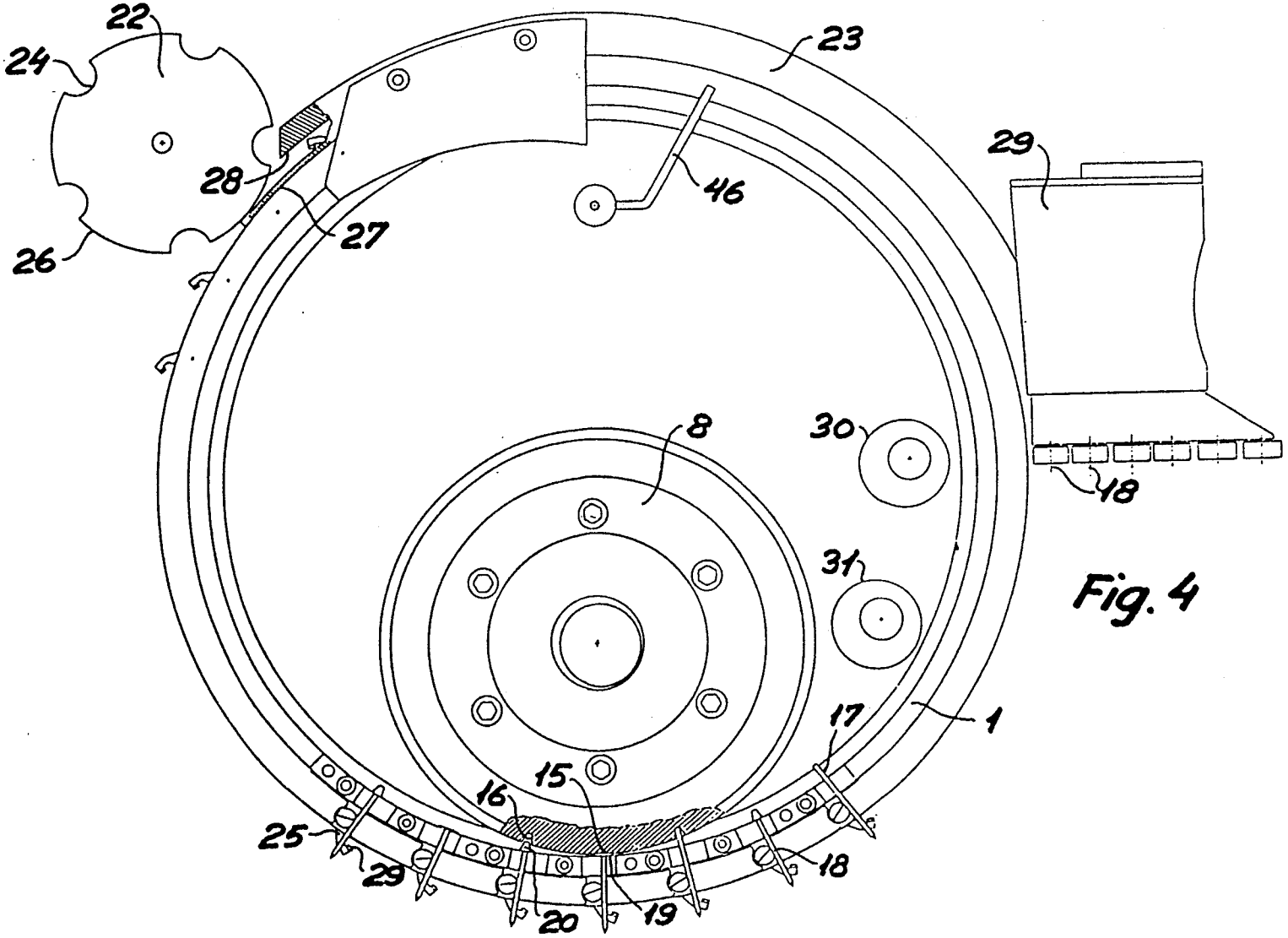
Figure 5:
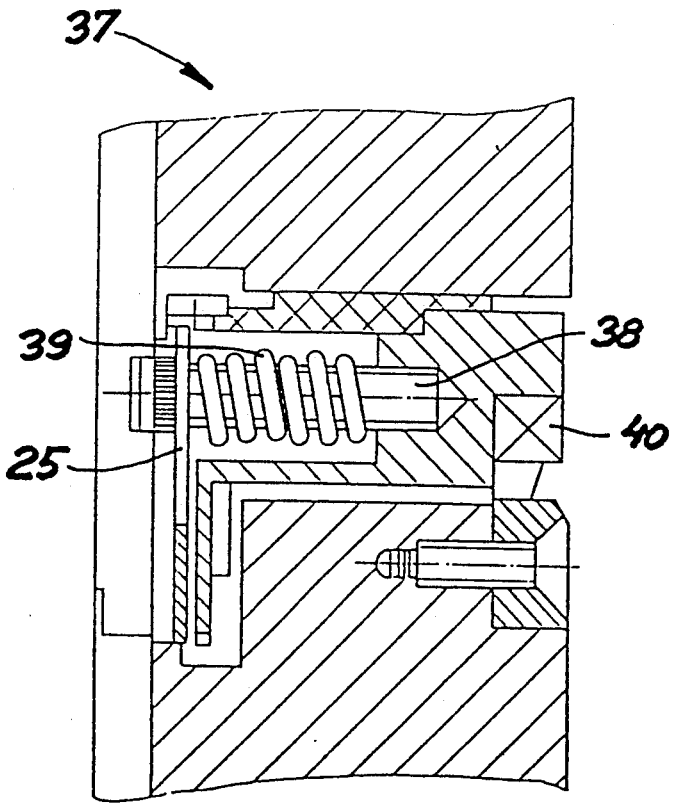
Figure 6:
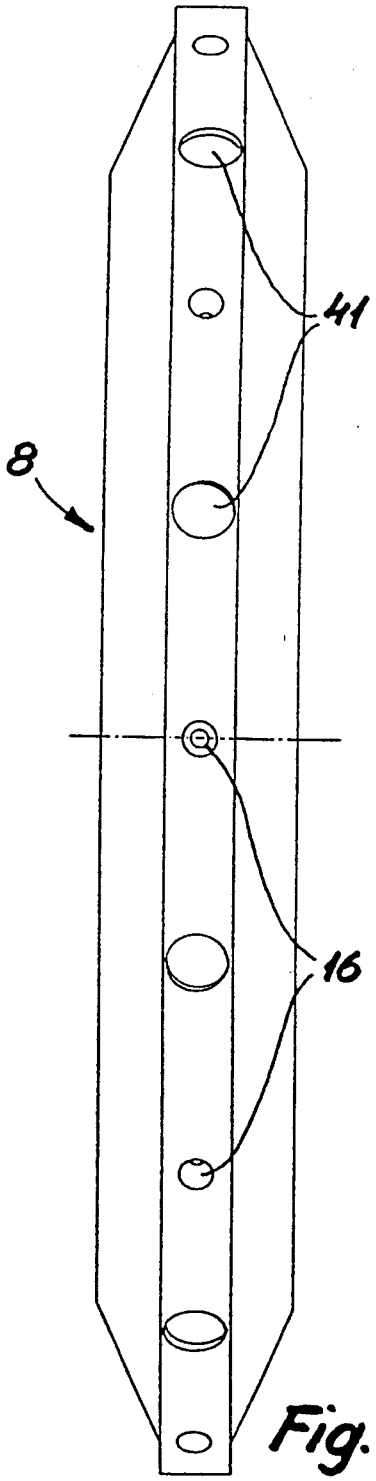
Figure 7:
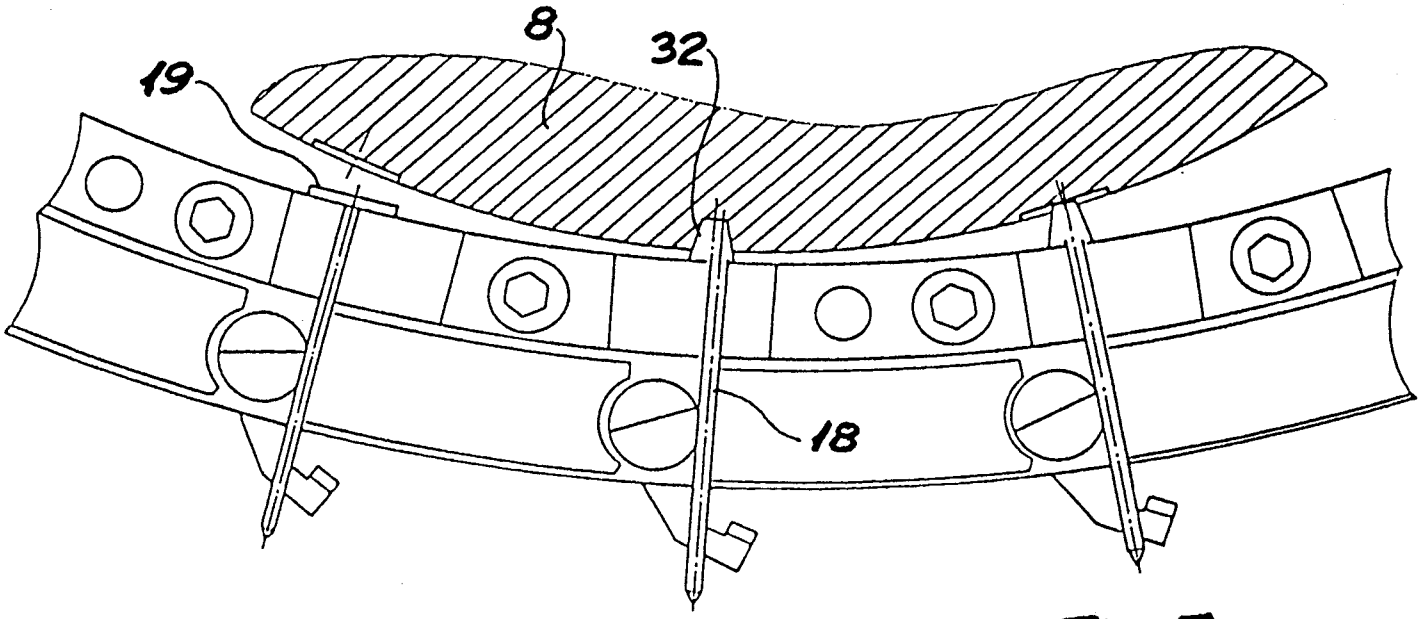
Figure 8:
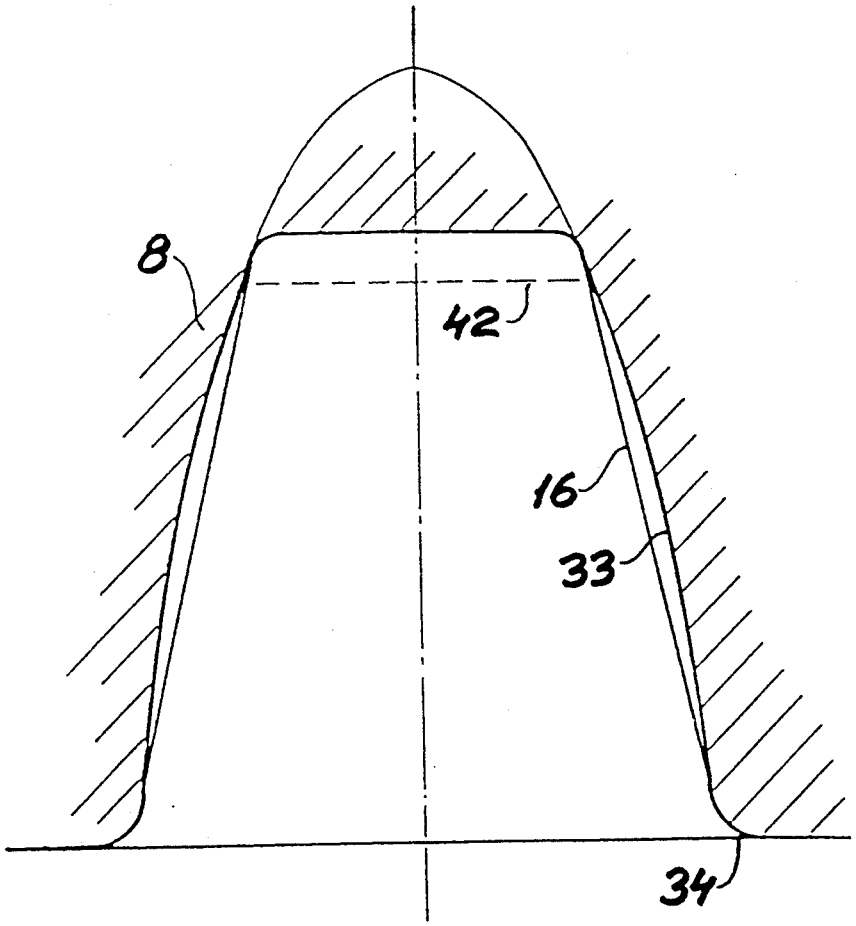
Figure 9:
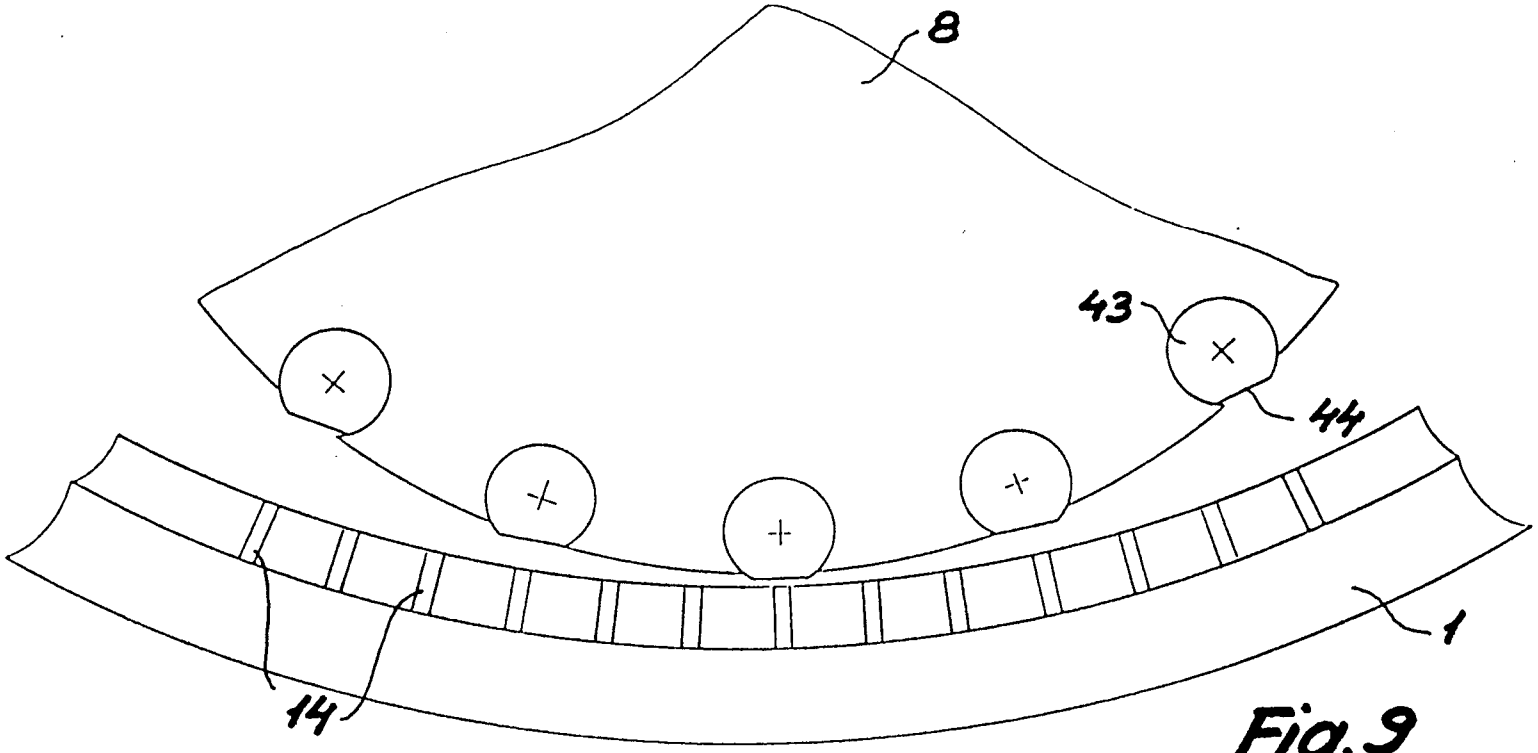
Figure 10:
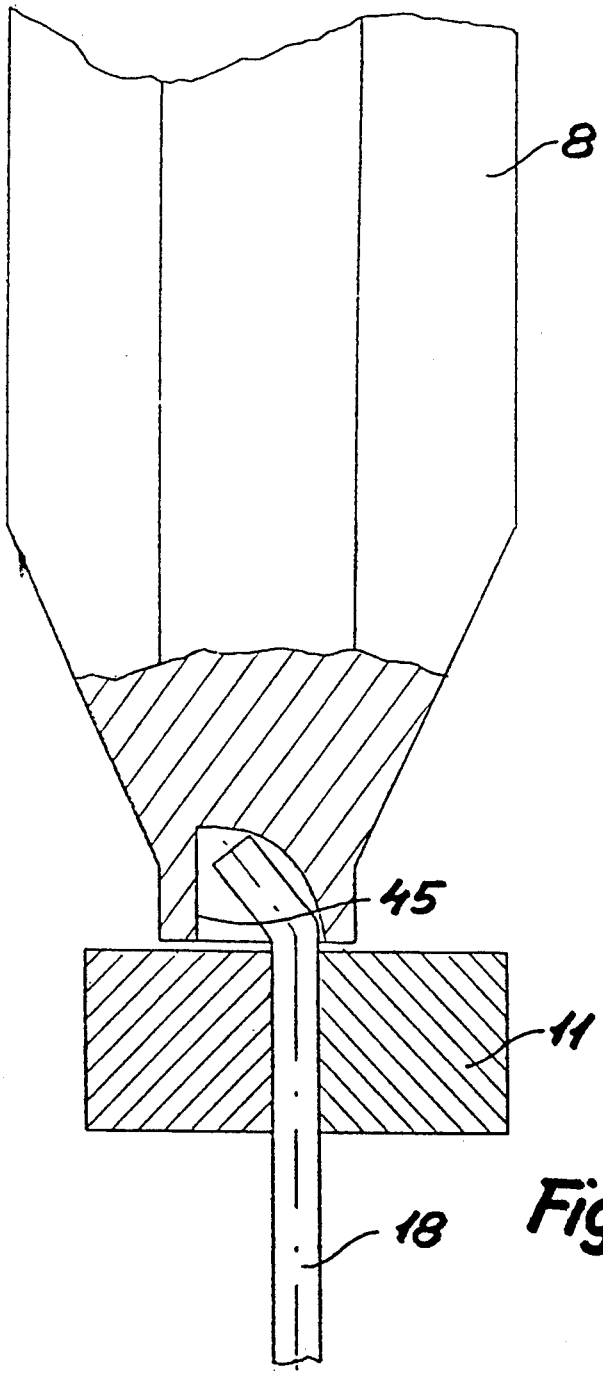

The invention will be explained more fully below with reference to the drawing, in which FIG. 1 shows a machine of a known type on which the manufacturing principle according to the invention is based, FIG. 2 is a sectional view along the line II—II of the machine illustrated in FIG. 1, FIG. 3 is a section of a preferred embodiment of a holding ring for cooperation with the roller of the invention, FIG. 4 shows a preferred embodiment of the machine of the invention, FIG. 5 is a sectional view of the holding ring shown in FIG. 3 and illustrates a locking mechanism adapted thereto, FIG. 6 is a side view of a preferred embodiment of a roller of the invention, FIG. 7 shows the cooperation of the roller illustrated in FIG. 6 with a holding ring, FIG. 8 shows a section of the roller and illustrates a preferred embodiment of a machining area provided in this, FIG. 9 shows another embodiment of the roller of the invention which is here provided with tilting tools, and, FIG. 10 shows a section of a third embodiment of the roller, seen from the side, and illustrates a cavity for machining a workpiece transversely to the feeding direction.

Initially, it is illustrated in FIGS. 1 and 2 on which machine and thus on which machining principle the invention is based.

Such a machine is known from the Danish Patent Specification 143 935 and is unique in that the workpieces are machined by so-called internal rolling. FIG. 2 shows a vertical cross-section through the machine shown in FIG. 1, and it will be seen how the holding rings 1 form part of the other constructional members of the machine. It appears that the machine is supported by two opposite plates 2 and 3, the plate 2 being stationarily secured to a given base, the plate 3 being pivotally mounted directly opposite the first-mentioned plate. The inner side of each of these plates mounts a bearing consisting of an inner ring 4 and an outer ring 5, the outer rings being secured to the inner rings 4 of the said bearings, one of said inner rings, viz. the one disposed in connection with the stationary carrier plates, being internally provided with a toothing 6, which is adapted to engage with a gear wheel 39 mounted on the drive shaft of the motor.

In operation of the machine, the motor drives the two opposed holding rings via the toothed inner ring in such a manner that the two opposed holding tools placed in said rings indirectly engage each other via the workpiece and in the vicinity of the machining area, a workpiece radially opposite a machining area being retained in the two opposed holding tools. When a workpiece is present in this position, its head is deformed corresponding to a mould cavity in the tools facing the ring centre, and the workpiece is released from the holding tools after completed rolling of the head because of the mutually inclined positions of the holding rings. This inclination causes an increasing mutual distance between the holding rings in both peripheral directions away from the position of the machining area radially opposite a workpiece where the greatest distance occurs at the common, upper vertex of the holding rings diametrically opposite said machining area. The mutually inclined positions of the holding rings are a preferred, known structure which involves simplification of the supply of workpieces and release of these after machining.

In the prior art, the workpieces are present in the holding rings less than an entire revolution, e.g. about 270°, but as will appear from the following, the known arrangement may be changed so that the workpieces may be present in the holding rings more than one revolution.

FIG. 3 illustrates a section of a holding ring 9 which is adapted for the machine and which is known in principle from the Danish Patent Application 1881/86. The holding ring is thus provided with a groove 10 adapted to receive a plurality of holding tools 11 with a plurality of various spacer tools 12 and 13 between each of these, said spacer tools being distributed according to a determined pattern and being moreover clamped in a direction toward the bottom of the groove, i.e. in the axial direction of the holding ring. Thus, the spacer tools 12 and 13 firmly position the holding tools 11 in the circumference of the holding ring by means of wedge effect, since both the holding and the spacer tools are provided with side faces which cut a plane, defined by the holding ring, in lines which are parallel with a groove 14 formed in the face of the tool. It will thus be appreciated that the radial pressure forces occurring in this structure between the roller 8 and the roll path formed by the holding tools 11 cannot be transferred to the other holding tools, disposed in the groove, in the entire circumference of the holding ring 9.

This constructional principle for the holding ring is important in connection with the new structure of the machine of the invention, because it is intended precisely for machining of workpieces where great movements of material may be necessary. As mentioned before, the machine is to handle workpieces which are to undergo two or more machining processes, and this is particularly important when the mentioned great movements of material are to be provided, such as e.g. for nails, screws or the like with large heads. To enable such deformations, the shaping according to the invention is divided into two or more sub-processes.

To produce workpieces in several process steps, the roller of the invention is therefore provided with mould cavities adapted to the individual types of workpieces, like the mentioned holding tools. These mould cavities move the workpiece material downwardly and sideways with respect to the mould cavities of the holding tools prior to the final rolling. This embodiment of the roller face will be described more fully below.

FIG. 4 is an overall illustration of an embodiment of the machine of the invention, and shows the novel components. It will thus be appreciated that this novel structure involves considerably increased flexibility in the fields of use of the machine since it is now possible to satisfy many different shape requirements thanks to various roller types and/or holding tools.

It should be mentioned that the known machines of this type are preferably driven so that the holding rings and the associated roller rotate with different peripheral speeds, the speed of the roller being preferably greater than that of the holding ring. The reason for the selection of such coaction between the roller and the holding ring is usually that, after contact with the roller, the workpiece is to be subjected to action in the feeding direction to obtain a better initial shaping.

However, this principle is not required in the machine of the invention. Owing to the fact that two or more initial part treatments of the workpieces can be obtained with the machine of the invention, this peripheral speed difference is no longer a practical necessity, so that wear on the engagement faces is reduced considerably. It has also been found to be easier to control the deformation sequence, in particular when moving relatively large masses of material, which has been solved according to the invention by a special arrangement of the roller.

Thus, FIG. 4 shows a preferred embodiment of the machine where the roller is provided with two different types of machining areas which are alternately disposed with the same mutual distance, one machining area 16 being adapted to pre-shape the inwardly extending free portion of the workpiece, while the immediately following machining area is to perform the final rolling, after which the workpiece is finished.

The first machining area 16 is, as appears from the figure, provided as a radially inwardly extending cavity 16, which is substantially in the form of a truncated cone whose axis coincides with a radius of the roller. The cavity 16 has this shape because of the deformation sequence which the free portion 17 of the workpiece 18 has, where this portion 17 is upset to the said truncated cone shape by the deformation. It will be appreciated that this shape is advantageous because so much material as possible is moved radially outwardly in the holding ring after the first shaping process. When the axial cross-section of the upset workpiece head 20 is narrowed upwardly, it will be appreciated that the deformation path and thus the flowability requirements are reduced, and at the same time a better filling of the mould cavity 21 of the holding tool is obtained.

FIG. 4 shows a starting workpiece 18 which is disposed in a position just before its free portion 17 is to undergo a first deformation process by coaction with the oppositely disposed cavity 16. The same workpiece is shown at 20 after upsetting. Since, as mentioned, this workpiece is to be subjected to a further process, it is to be moved with the holding ring another revolution while being still retained, so that the head 20 of the workpiece then undergoes the final machining via the roller face 15, whereby the head of the workpiece has been given its final shape and is finished. Then the workpiece is moved on for release from the holding rings. For this operation to be feasible, it is necessary to have a switching mechanism which is so adapted that workpieces that have still not been finished are allowed to pass the release location and be moved with the holding rings while being still retained up to the mentioned final rolling process. This switching mechanism may be provided as a so-called timer wheel 22 and a guide rail 23 cooperating with it.

The timer wheel 22 is peripherally provided with notches 24 with a mutual arc distance, which corresponds to the arc length between every second workpiece, externally on the holding ring, said timer wheel being rotated with a peripheral speed corresponding to that of the holding ring.

The timer wheel 22 is so geared with respect to the positions of the workpieces in the holding ring that the locking pawls 25, which extend radially outwardly from the outer side of the holding ring to retain finished workpieces, will contact a release face 26 on the timer wheel. The release pawl Z5 is hereby forced outwardly and releases a locking device in the holding ring, following which the workpiece is finally released by a projecting means 46. Upon further rotation of the holding ring, the pawl 25 is moved in its releasing position to the said, adjoining guide rail 23, which for this purpose is provided with two guide faces 27 and 28 displaced in the radial direction of the holding ring. Thus, the locking pawl 25 leads into the radial innermost guide face 27 of the guide rail 23 whereby the locking mechanism is held in a released position forwardly to a feed device or guide pin 29, where a new workpiece is fed to the empty holding tool.

In contrast to the foregoing workpieces which have just undergone the first shaping process will be moved toward the timer wheel 22 in such a manner that the locking pawls 25 associated with these workpieces will be received in the notches 24 of the timer wheel, so that the workpieces are still retained, and so that a guide pin 29 mounted for the purpose in a radial extreme position on the locking pawl engages the said second guide face 28 of the guide rail, which causes the workpiece to still be locked in the further feeding to the final machining.

The said locking mechanism 27, which is of known type, is illustrated in FIG. 5 and operates in that the locking pawl 25, which is rotatably secured to a pin 38 and is biased via a spring 39, can be forced radially into the holding ring, so that a locking eccentric 40, provided in a slidably journalled bushing, can be rotated to a non-locking position where the locking pawl 25, likewise after insertion of a workpiece, moves into its locking position.

New workpieces are inserted into the empty holding tools by means of a feed device adapted for this (a so-called manipulator) 29, which, to ensure correct insertion time, is so geared with respect to the rotation of the holding ring that insertion of a workpiece takes place precisely with intervals corresponding to the time for the passage of twice the arc length between two workpieces.

It will be appreciated that workpieces are to be inserted at a relatively great speed, which takes place by continuous rotation of the holding ring. To arrest the workpiece at the insertion, a positioning roller 30 is provided, said roller being adjustable in connection with various workpiece shapes. This roller positions the workpiece radially a little too far inwardly to ensure sufficient material, and upon further rotation the workpiece meets another, fixed positioning roller 31 which is adapted for the final, radial positioning of the workpiece before this is subjected to the first deformation.

In the shown preferred embodiment, the roller 8 is provided with two different machining areas, so that the total number of machining areas in the circumference of the roller is an even number. This is because the number of workpieces in the holding ring may not be divisible by multiple of the number of various types of machining areas on the roller so as to ensure that the individual workpiece in the holding ring will be subjected to the correct shaping process when returning to the machining area radially opposite to this, which is tantamount to the roller and the holding ring, after each revolution of the latter, having been displaced precisely an arc section corresponding to a multiple of the distance between two machining areas.

It will likewise be appreciated that the roller may be provided with another number of various machining areas, in accordance with adapting the above-mentioned proportion between machining areas and the number of workpieces in the holding ring.

In FIG. 6, the roller 8 is illustrated as seen from the roller side, so that the mentioned mould cavities 16 and the roller areas 41 disposed between these are visible.

FIG. 7 shows an enlarged section of the roller 8, which corresponds in principle to the view of FIG. 4, but the roller is here provided with a mould cavity 32 which differs from the above-mentioned cavity in that, when disposed radially opposite a workpiece, it is displaced a distance in the feeding direction, which entails that the mass of material upset by this is correspondingly moved ahead with respect to a plane through the axis of the workpiece and the centre of the roller.

This structure of the roller counteracts the flowing of material otherwise occurring which causes the material to tend to be pushed in the direction opposite the feeding direction, so that, after completed process, the distribution of the material will be disuniform. It is thus possible to produce heads for oblong objects having a considerably improved size and finish.

FIG. 8 shows another embodiment of the mould cavities of the roller. As will be seen, the truncated cone shape 16 and 32 has been replaced by a substantially paraboloid cavity 33. This shape is particularly advantageous since the natural flow of the material follows a paraboloid shape, so that some of the frictional forces, which would otherwise occur by upsetting according to the above-mentioned cavities, will be removed, which is important in connection with the already great flow of material in the process, and which, of course, reduces the risk of cracks and ruptures in the machined material. It also appears, as indicated at 42 in the figure, that the requirement in respect of the necessary cavity depth has been reduced. To avoid pressure or tearing impacts on the truncated cone material 20 when the cavity leaves the truncated cone, the cavity may be rounded, as indicated at 34, so as to ensure a correctly shaped and unaffected workpiece cavity 20, while reducing wear on the roller.

FIG. 9 illustrates the principle of an alternative embodiment of the roller. The machining areas of the roller are movable so that the contact face of the machining area from engagement with a workpiece is constantly disposed radially opposite said workpiece until the contact face of the machining face releases the workpiece machined.

This manufacturing method is possible in that the movable machining areas or so-called tilting tools 43 are arranged as circular discs which are journalled around their axis, somewhat radially inwardly toward the roller centre at a distance which is slightly smaller than the radius of the tilting tool. Thus, part of the circular tilting tool protrudes radially from the roller periphery, said part, viz. the machining face 38, having been planed for engagement with an oppositely disposed workpiece. It will be appreciated that the face 38 may be provided with different forms of stamping contours, such as a cutting tool for cutting slots on screws.

It will likewise be appreciated that the tilting tools may be so journalled in the roller that there is spring mechanism (not shown) for biasing the tilting tools so that these, after having released the workpiece in question, rotate back to their starting position shown at 37.

With the above-mentioned structure, there is thus provided a roller which entails that the machining area on the tilting tools are capable of performing longitudinal and transverse, translatory movements simultaneously, which, as mentioned, is of importance in the production of relatively deep stamping contours. It will be appreciated that in addition to the tilting tools the roller may have other machining areas, which is symbolized in the figure by the presence of two workpieces between the workpieces cooperating with the tilting tools.

FIG. 10 shows another embodiment of the roller of the invention where the machining areas comprise mould cavities 45 which, in contrast to the above-mentioned cavities, serve to provide bending of the free portion of the workpiece in directions transverse to the feeding direction, following which the workpiece is subjected to final rolling. Such initial shaping is adapted to be used in connection with the production of objects having D-shaped heads, where the straight edge of the head is parallel with the feeding direction in the holding ring. This orientation is known from the Danish Patent Application 3490/79 and prevents formation of burrs.

I claim:

1. A method of machining an oblong workpiece (18), which is placed substantially radially in a ring-shaped tool and is deformed by cooperation with a roller (8) rotating in a hold ring (1), comprising driving the roller relative to the position of the workpieces in the holding ring so that each workpiece is caused to cooperate with a plurality of differently shaped areas (16) of the surface of the roller.

2. A method according to claim 1, wherein the workpieces are subjected to a preliminary deformation in the form of upsetting of material in that the machining areas on the roller corresponding thereto are provided as mould cavities (22) which extend radially inwardly toward the centre of the roller.

3. A method according to claim 1, wherein the workpieces are subjected to a preliminary deformation in the form of shearing of material transverse a the longitudinal direction of the workpiece.

4. A method according to claim 1, wherein the roller comprises a plurality of machining groups, each of which has a plurality of mutually different machining areas, and that the roller is driven relative to the position of the workpieces in the holding ring so that a workpiece is caused to cooperate with a predetermined succession of the various machining areas (16 and 41).

5. A method according to claim 1, wherein the roller and the holding ring cooperating with it are driven with the same peripheral speed.

6. A method according to claim 1, wherein the workpieces in the holding ring are distributed with the same mutual distance and in a number which is not divisible by the number of machining areas on the roller.

7. A method according to claim 1, wherein following one or more preceding machining processes the workpieces are subjected to final shaping by means of machining areas (44) rotatably journalled in the roller, and that a machining area performs a substantially radial movement with respect to the holding ring, from engagement with the workpieces and until completed shaping.

8. A machine for machining oblong workpieces (18) and comprising a rotating holding ring (1) for substantially radial retention of the workpieces and comprising a rotating roller (8) provided within the holding ring to machine the radially inwardly directed end (17) of the workpieces, wherein at least two differently shaped types of machining areas (16 and 41) are provided along the surface of the roller, said machining areas being so disposed and the roller so driven that the various types of machining areas are present radially opposite a workpiece in a predetermined succession at least at the same time as the holding ring performs a corresponding number of entire revolutions.

9. A machine according to claim 8, wherein a first type of machining areas on the groups of such areas on the roller are provided as a mould cavity (32) which extends from the periphery of the roller radially inwardly toward the centre of the roller, with a narrowed cross-section.

10. A machine according to claim 9, wherein said mould cavity is partly defined by a paraboloid-of-revolution wall.

11. A machine according to claim 9, wherein the equidistantly spaced mould cavities (32) corresponding to the machining areas on the roller are displaced a distance forwardly with respect to the other machining areas of the roller so that an axis of the mould cavity through the centre of the roller is disposed in a plane displaced from the axis of the workpiece when the cavity is present radially opposite such a workpiece.

12. A machine according to claim 8, wherein a second type of machining areas (45) in the groups of such areas in the roller is provided as shaping projections having shaping faces which form an angle with a common radial plane for the holding ring and the roller.

13. A machine according to claim 8, wherein the roller and the holding ring are driven by means of a gear mechanism (6 and 39), which has such a transmission that the roller is driven with a peripheral speed so adapted with respect to the positions of the workpieces in the holding ring that the workpiece is caused to cooperate with a predetermined succession of mutually different machining areas in the groups of such areas of the roller.

14. A machine according to claim 8, wherein a workpiece insertion station (29) is provided radially opposite the holding ring and that the station is adapted to insert workpieces at intervals extending over a plurality of workpieces in the holding ring corresponding to the number of mutually different machining areas on the roller.

15. A machine according to claim 14, wherein the roller is divided into a plurality of groups, each of which comprises at least two different machining areas along the surface of the roller, and that the holding ring is adapted to receive an odd number of workpieces.

16. A machine according to claim 8, wherein one of the machining areas (44) in each group is provided as tilting tools (43) having a tilting axis which is disposed outside the axis of the roller and parallel with it, the tilting tools corresponding to each of said machining areas being provided as roller sections movable in the radial plane of the roller.

17. A machine according to claim 16, wherein the machining area adapted for the final shaping consists of a tilting tool (43) which is adapted to perform a final, calibrating function.

* * * * *